US009681789B2

(12) United States Patent
Weaver et al.

(10) Patent No.: US 9,681,789 B2
(45) Date of Patent: Jun. 20, 2017

(54) FLOOR MOP WITH SCRUBBER

(71) Applicant: Quickie Manufacturing Corporation, Cinnaminson, NJ (US)

(72) Inventors: Jace Weaver, Gilbertsville, PA (US); David Wilusz, Philadelphia, PA (US)

(73) Assignee: Quickie Manufacturing Corporation, Cinnaminson, NJ (US)

( * ) Notice: Subject to any disclaimer, the term of this patent is extended or adjusted under 35 U.S.C. 154(b) by 275 days.

(21) Appl. No.: 14/697,591

(22) Filed: Apr. 27, 2015

(65) Prior Publication Data

US 2016/0256029 A1 Sep. 8, 2016

Related U.S. Application Data

(60) Provisional application No. 62/128,991, filed on Mar. 5, 2015.

(51) Int. Cl.
*A47L 13/256* (2006.01)
*A47L 13/257* (2006.01)
*A47L 13/12* (2006.01)

(52) U.S. Cl.
CPC ..... *A47L 13/256* (2013.01); *A47L 13/12* (2013.01); *A47L 13/257* (2013.01)

(58) Field of Classification Search
CPC ..... A47L 13/256; A47L 13/257
See application file for complete search history.

(56) References Cited

U.S. PATENT DOCUMENTS 8,166,597 B2 * 5/2012 Levitt ..... A47L 13/12 15/118

* cited by examiner

*Primary Examiner* — Shay Karls
(74) *Attorney, Agent, or Firm* — Husch Blackwell LLP

(57) ABSTRACT

The present invention relates to a floor mop with a handle and mop head having a base, handle connector, and scrubbing mechanism. The base may include a platen and cleaning pad and is connected to the mop handle through the handle connector. The base may also include an opening for holding the handle connector and scrubbing mechanism. The handle connector houses the components of the scrubbing mechanism, including a scrubbing pad, axle, slide and spring. The scrubbing pad is located on the lower surface of the handle connector. The axle is connected to the base of the mop head and to the slide so that when sufficient downward force is applied to compress the spring, the scrubbing pad moves downward relative to the lower surface of the handle connector so that the scrubbing pad engages the cleaning surface.

13 Claims, 6 Drawing Sheets

FLOOR MOP WITH SCRUBBER

CROSS REFERENCE TO RELATED APPLICATIONS

This application claims priority to U.S. Provisional Application Ser. No. 62/128,991, filed Mar. 5, 2015, which is hereby incorporated by reference.

FIELD OF THE INVENTION

The present invention relates to a floor mop, and, more particularly, to a floor mop having a retractable scrubber for removing difficult spills or engrained items on a floor or similar moping surface.

BACKGROUND OF THE INVENTION

Conventional mops generally allow a user to clean or dust floors, walls and similar surface by moving a mop head across the surface via a mop handle. Routinely, mops include a cleaning sheet or pad that contacts the surface and removes dirt, dust, and debris. However, such conventional mops are generally inefficient or incapable of removing items on the floor or surface that are stuck or engrained on the surface. Typically, when the user pushes the mop head across the floor, the cleaning pad fails to remove difficult stuck or engrained items on the floor or surface. Often, regardless of how much force the user exerts on the mop handle (and thereby, the mop head), the cleaning sheet or pad is insufficient to properly clean the floor. The user generally ceases using the mop and instead employs a scrubber or similar device to remove such items before resuming the use of the mop.

Thus, a need exists for a mop that can allow the user to effectively and easily remove stuck or engrained items on the floor or similar moping surface.

BRIEF SUMMARY OF THE INVENTION

The present invention relates to a mop that includes a handle and a mop head having a handle connector and selectively retractable scrubbing mechanism. The mop head can include a platen and a cleaning pad on the undersurface of the platen that can remove dirt, dust and other loose objects from a floor, wall, or similar moping surface. The handle connector may secure the mop head to the mop handle and house the components of the scrubbing mechanism. The handle connector and scrubbing mechanism may be located within an opening formed in the platen and cleaning pad. The scrubbing mechanism may include a spring and slide housed within a cavity located in the handle connector. Affixed to the slide may be an axle that is secured to the platen of the mop head. Beneath the handle connector may be a scrubbing plate with a scrubbing pad affixed thereto. The spring in the connector cavity allows the user of the mop to apply a force to the handle that compresses the spring, thereby forcing the scrubbing pad downward below the undersurface of the cleaning pad, enabling the user to employ the scrubbing pad to clean stuck or engrained items located on the cleaning surface. Once the user is finished removing the stuck or engrained items, the user may reduce the downward force applied to the handle, thereby causing the spring to move back to its uncompressed position where the scrubbing pad is located above the undersurface of the cleaning pad, allowing the user to resume moping the cleaning surface.

The scrubbing mechanism allows the user of the mop to go from moping to scrubbing by simply applying the requisite force to the handle to place the scrubbing mechanism into an extended position. The user may then resume moping by reducing the force applied to the handle to place the scrubbing mechanism back into a retracted position.

Other aspects and advantages of the present invention will be apparent from the following detailed description of the preferred embodiments and the accompanying drawing figures.

Figure 1:
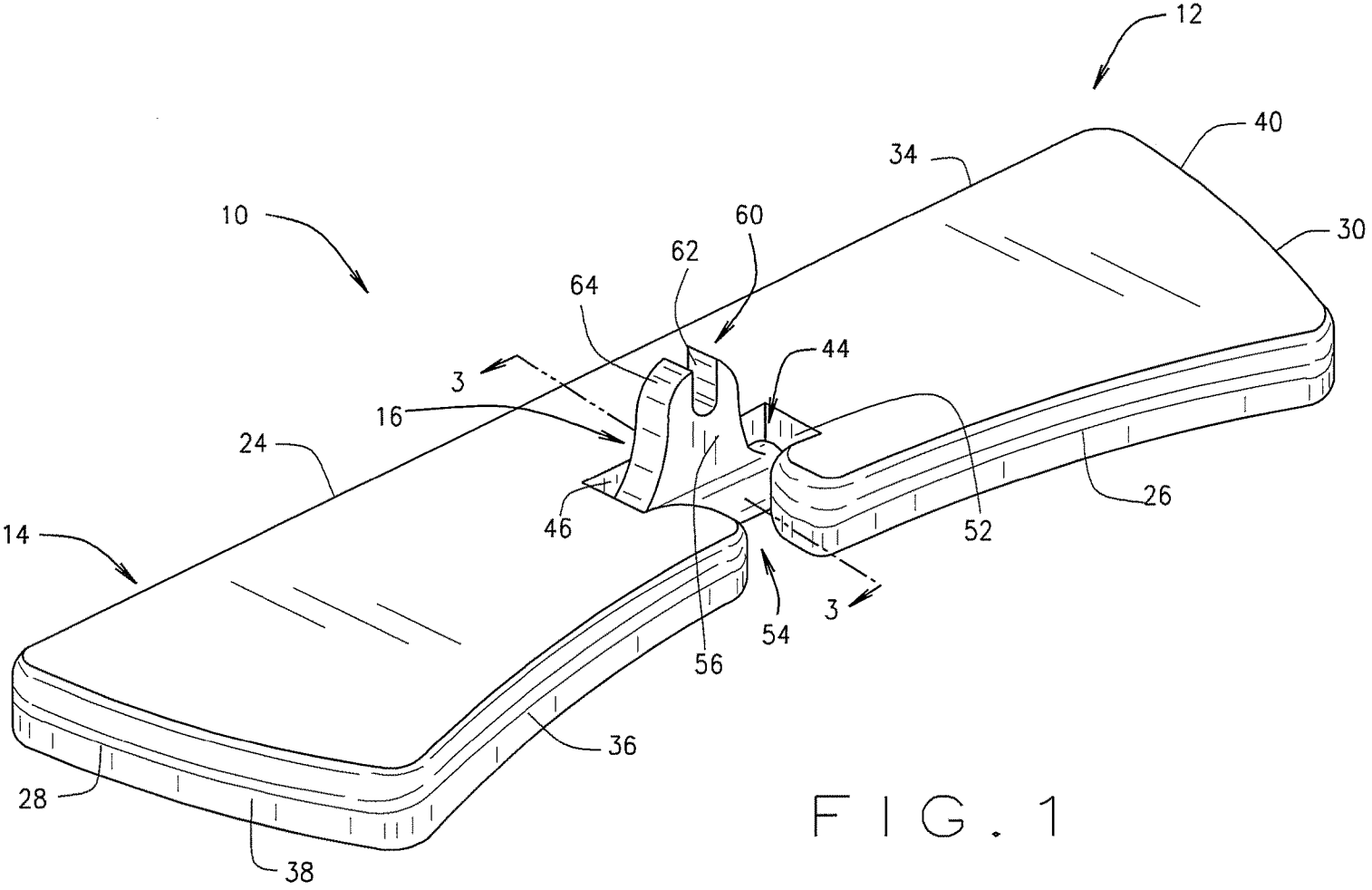
FIG. 1 is a top perspective view of a mop with a scrubbing mechanism according to an embodiment of the present invention.

While the disclosure is susceptible to various modifications and alternative forms, a specific embodiment thereof is shown by way of example in the drawing and will herein be described in detail. It should be understood, however, that the drawings and detailed description presented herein are not intended to limit the disclosure to the particular embodiment disclosed, but to the contrary, the intention is to cover all modifications, equivalents, and alternatives falling within the spirit and scope of the present disclosure as defined by the appended claims.

DETAILED DESCRIPTION OF THE INVENTION

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

Figure 2:
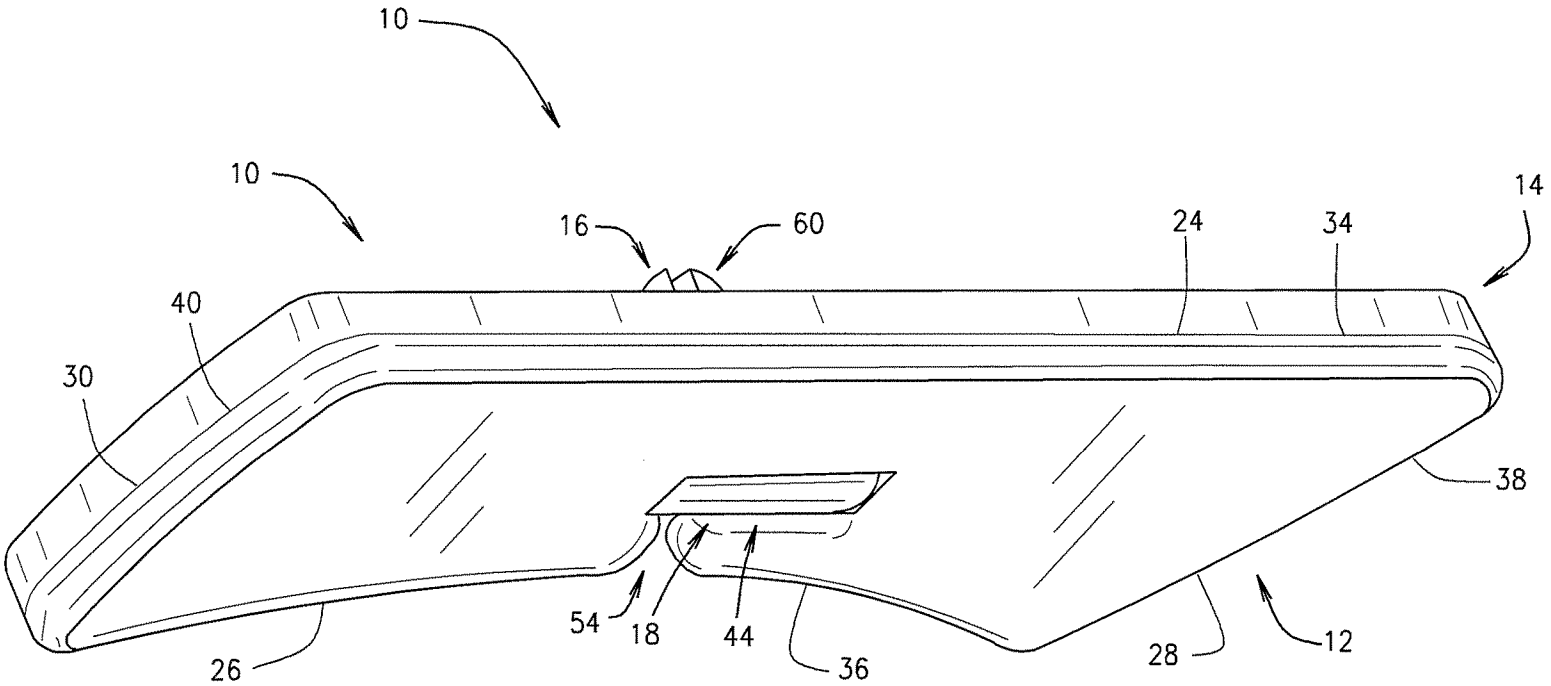
FIG. 2 is a bottom perspective view of the mop of FIG. 1 illustrating the scrubbing mechanism.

Referring to the drawings particularly by reference numbers wherein like numerals refer to like parts, FIGS. 1 and 2 illustrate the various views of a mop 10 comprising a mop head 12 and a handle (not shown). The handle may comprise an elongated rod or shaft constructed from wood, plastic, metal or any other suitable material commonly used to construct mop or broom handles. The handle may have a circular, square, rectangular or other suitably shaped cross section. The mop head 12 may comprise a base 14, handle connector 16, and a scrubbing mechanism 18. The handle may be connected to the base 14 via the handle connector 16 to form the mop 10.

Figure 5:
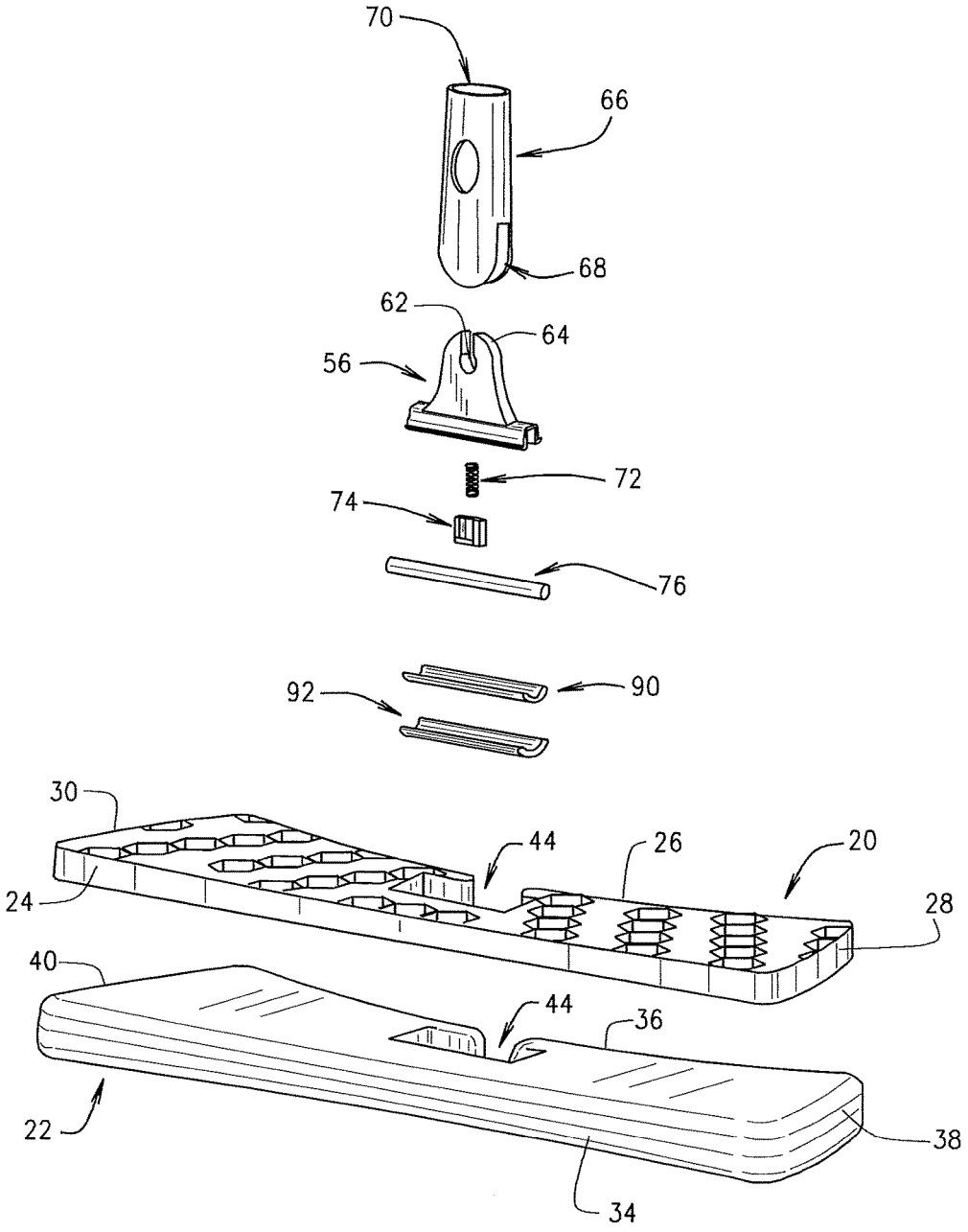
FIG. 5 is an exploded view of the mop of FIG. 1.

As can be seen in FIG. 5, the base 14 may comprise a platen 20. The platen 20 may have a front edge 24, rear edge 26, left and right edges 28 and 30, and an undersurface 32. The platen 20 defines the overall form of the mop head 12 and may have a generally rectangular shape. However, any number of other shapes may be suitable for the platen 20. The platen 20 may be constructed from plastic, metal, wood, rubber or the like. The base 14 may also include a mitt or cleaning pad 22. The mitt or cleaning pad 22 may have a shape that generally conforms to the shape of the platen 20 and includes a front edge 34, rear edge 36, left and right edges 38 and 40, and an undersurface 42 that generally corresponds to the edges and undersurface 24, 26, 28, 30 and 32 of the platen 20, respectively. As shown in FIG. 1, the cleaning pad 22 may be in the form of a sleeve that fits over the platen 20. The cleaning pad 22 may also be secured to the undersurface 32 of the platen 20 by any conventional means in alternative embodiments. The cleaning pad 22 may be constructed from any number of materials commonly used for cleaning, such as foams, plastics, fabrics, papers materials, wire meshes, and the like.

As best shown in FIGS. 1 and 2, the base 14 may include an opening 44 for receiving the handle connector 16 and scrubber 18. The embodiment shown in FIGS. 1 and 2 shows the base 14 having only a single opening 44. However, in alternative embodiments, the base 14 may include two of more openings 44 for receiving multiple handle connectors 16 and/or multiple scrubber mechanisms 18. The opening 44 may have a generally rectangular shape with a front wall 46, rear wall 48, a left wall 50, and a right wall 52. As shown in FIG. 1, rear wall 48 may include a gap 54. The opening may have any other suitable shape that allows the handle connector 16 and scrubbing mechanism 18 to be housed within the opening 44. Additionally, the opening 44 may have any number of different sizes suitable for receiving the connector 16 and scrubbing mechanism 18. The opening 44 may be located at any location within the perimeter of base 14. In the embodiment shown in FIGS. 1 and 2, the opening 44 is generally centered between the left and right edges 28 and 30 of platen 20 and near the rear edge 26 of the platen 20. However, several other locations are anticipated as well.

Figure 3:
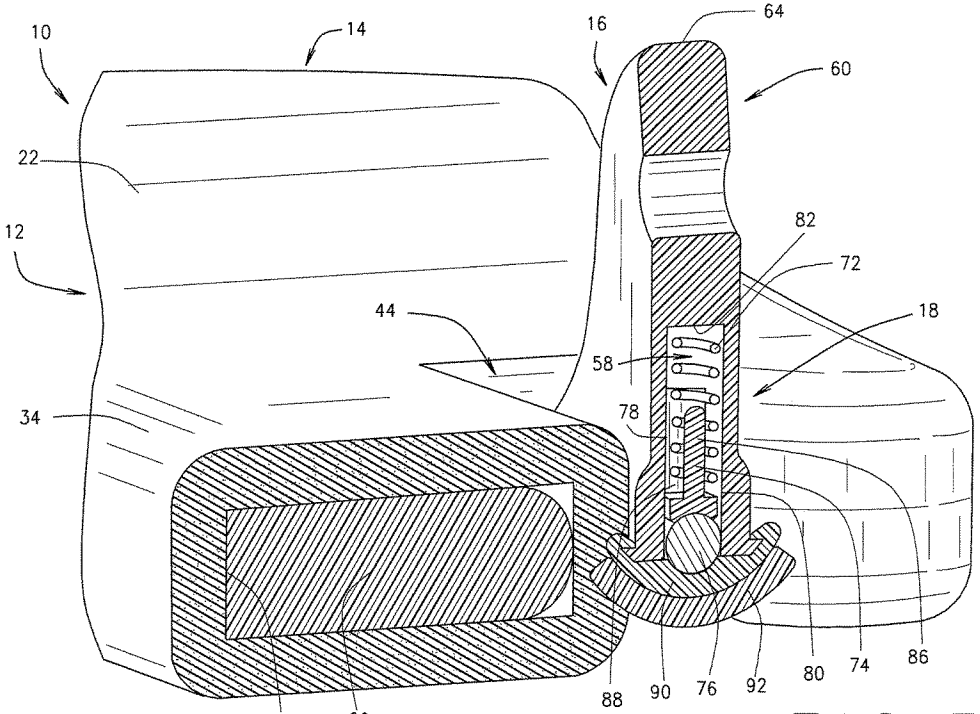
FIG. 3 is a side perspective section view of the mop of FIG. 1, taken along line 3-3 and illustrating the components of the scrubbing mechanism in a retracted position.
Figure 4:
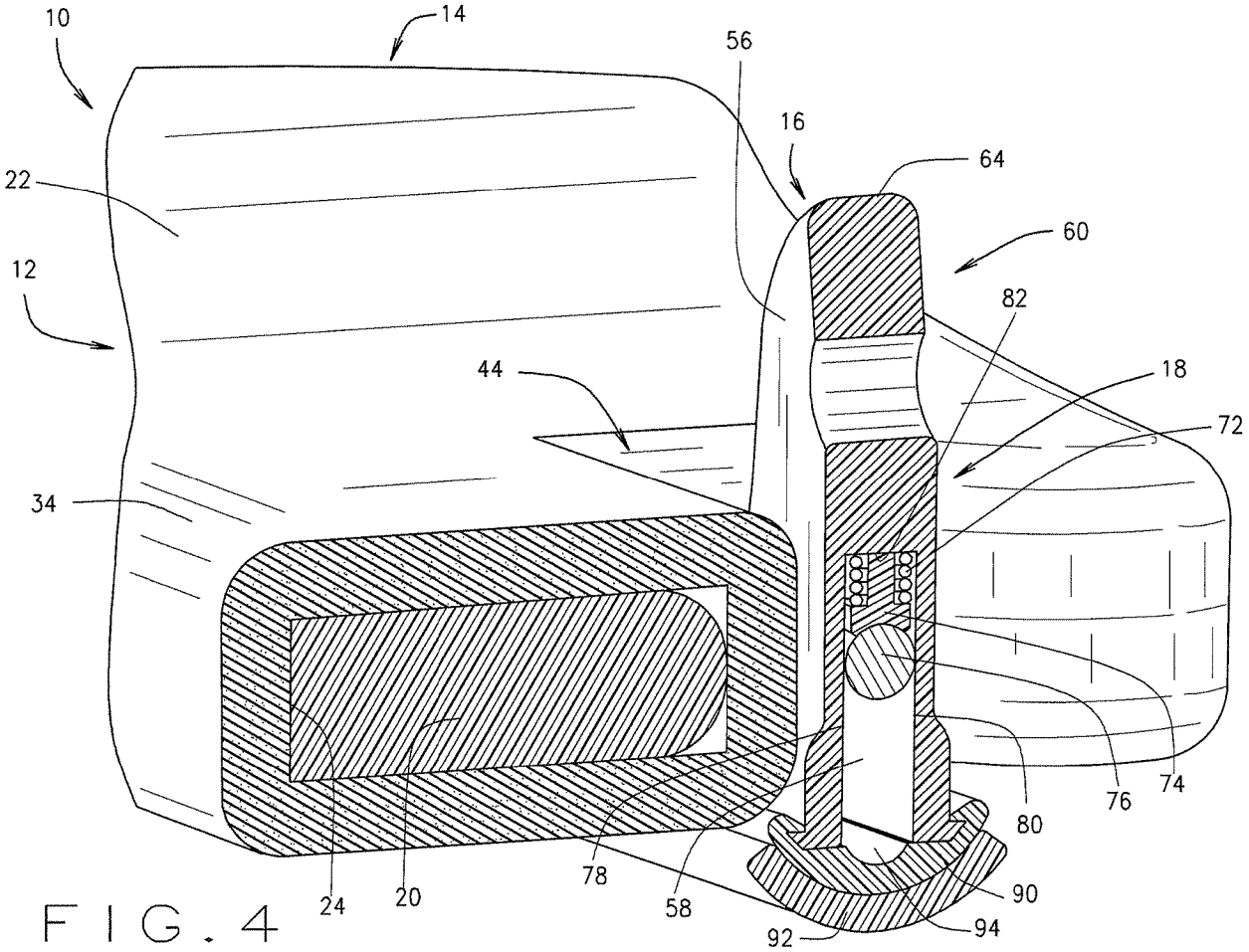
FIG. 4 is a side perspective section view of the mop of FIG. 1, taken along line 3-3 and illustrating the components of the scrubbing mechanism in an extended position.

Within opening 44 may be the handle connector 16 and scrubbing mechanism 18. As best seen in FIGS. 3 and 4, the handle connector 16 may comprise a housing 56 having a cavity 58 and attachment structure 60. The housing 56 may have any suitable shape, such as rounded, square, rectangular, or other suitable shape, that allows the cavity 58 to be formed inside. Additionally, the housing 56 may have any number of different sizes so long as the housing 56 may be received, at least partially, within the opening 44. The attachment structure 60 may facilitate attaching the handle (not shown) to the mop head 12 and connector 16. The attachment structure 60 may contain a notch 62 (see FIG. 1) defined within its terminal edge 64 to facilitate connecting the handle connector 16 to the handle. In one embodiment, as shown in FIG. 5, the shape of the attachment structure 60 conforms to a terminal end opening 68 of a yolk 66 that may receive the handle at its opposing terminal end 70. The figures show attachment structure 60 having a rounded top edge 64 and flat sides that conform to the yolk 66. However, in alternative embodiments, the attachment structure 60 may have a flat edge 64 and/or rounded sides and/or other suitable shapes and forms. Additionally, the attachment structure 60 may be designed to directly connect to the handle without the use of a yolk 66.

The cavity 58 within housing 56 may hold a spring 72, slide 74, and axle 76 that collectively operate the scrubbing mechanism 18. The cavity 58 may be in the form of an elongated channel open at one end as best shown in FIGS. 3 and 4. In other embodiments, the cavity 56 may be completely enclosed. The cavity 58 may be defined by front and rear walls 78 and 80 and a top wall 82 as best shown in FIGS. 3 and 4. The distance between the front and rear walls may be of any dimension slightly greater than the diameter or width of the axle 76. In the embodiment shown in the figures, the distance between the front and rear walls 78 and 80 is only slightly greater than the diameter of axle 76 so that the walls 78 and 80 guide the axle 76 when the scrubbing mechanism 18 moves from a retracted position to an extended position. The height of the top wall 82 is selectively configured to allow for retraction of the scrubbing mechanism 18 as described in greater detail below.

The axle 76 mounts the handle connector 16 to the platen 20 of base 14. The axle 76 may be a rod or shaft, having a generally rounded cross-section and constructed from metal, plastic, wood or other suitable material. The axle 76 may also have a rectangular or other shaped cross-section in alternative embodiments. The axle 76 includes two terminal ends 84 that are designed to be received within mounting points (not shown) located in the left and right walls 50 and 52 of opening 44 of platen 20 that may rotatably or fixedly mount axle 76 to the platen 20. In an alternative embodiment, the axle 76 may be mounted to the front and rear walls 46 and 48 of opening 44.

Located within the cavity 58 and above the axle 76 is the slide 74 and spring 72 as best shown in FIG. 3. The slide 74 may have a lower surface 84 that generally conforms to the shape of the axle 76 and an engaging means 86 that couples the spring 72 to the slide 74. The lower surface 84 may be secured to the axle 76 using any common methods. The slide 74 may also include a guiding wall 88 that is selectively configured to maintain the horizontal position of slide 74 within the cavity 58. In one embodiment, the guiding wall 88 has a width slightly less than the distance between the front and rear walls 78 and 80 of the cavity 56.

As shown in FIGS. 3 and 4, the spring 72 may be a compression spring with one end secured to the top wall 82 of cavity 56. The spring 72 may be a constant linear rate compression spring or variable rate spring in alternative embodiments. As shown in FIG. 3, one end of spring 72 may receive the engaging means 86 of the slide in order to couple the spring 72 to the slide 74. In an alternative embodiment, the end of spring 72 may be hooked or fastened to engaging means 86 to couple the slide 74 to the spring 72. In another alternative, the spring 72 may simple reside within the cavity 56 without being connected to another component. The spring 72, slide 74, and axle 76 allows the housing 56 and handle connector 16 to move up or down relative to the base 14 of the mop head 12. This is best seen by comparing the relatively constant position of axle 76 and slide 74 in FIGS. 3 and 4 with the compression of spring 72 and the change in position of housing 56 from FIG. 3 to FIG. 4.

Figure 6:
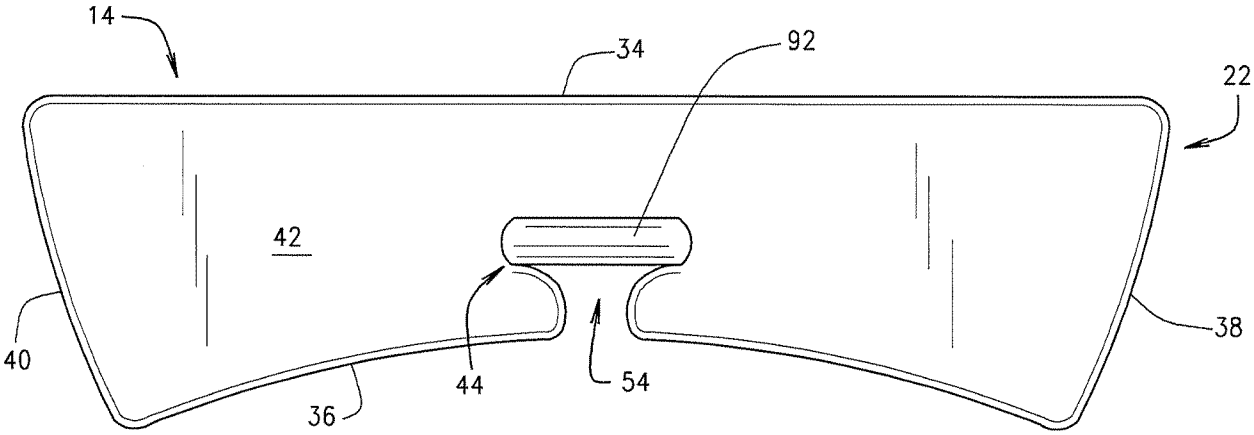
FIG. 6 is a bottom plan view of the mop of FIG. 1.
Figure 7:
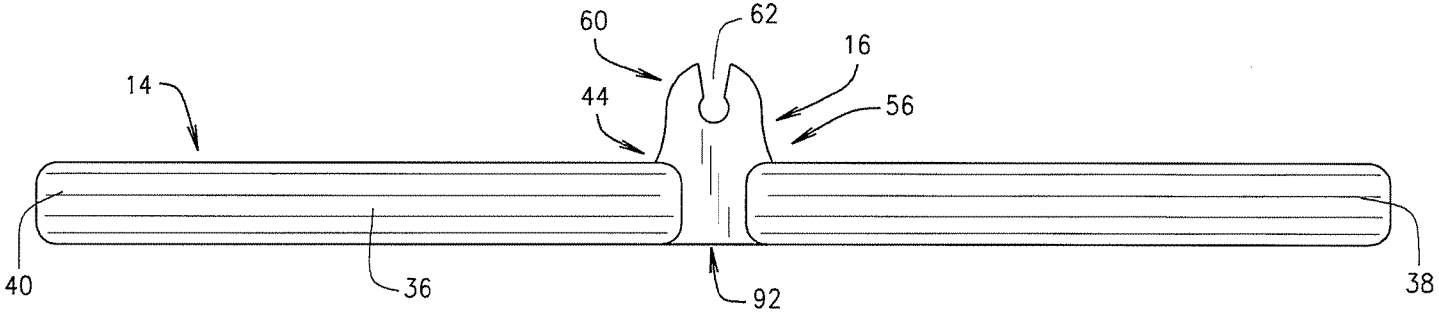
FIG. 7 is a side elevation view of the mop of FIG. 1.

Located beneath the handle connector 16 and housing 56 may be a scrubbing plate 90 and scrubbing pad 92, as best shown in FIGS. 3 and 4. The scrubbing plate 90 may be secured to the lower surface of the housing 56 by any suitable means. In alternative embodiments, the scrubbing plate 90 may be secured to other areas of the housing 56. The scrubbing plate 90 may also include an indention 94 on its inner surface that conforms to the shape of the axle 76 as best shown in FIG. 4. The scrubbing plate 90 may also have an outer surface that generally conforms to the inner surface of the scrubbing pad 92 to facilitate securement of the scrubbing pad 92 to the scrubbing plate 90. The scrubbing plate 90 may be constructed from any number of suitable materials, such as plastics, metals, rubbers, and the like. The scrubbing pad 92 may be constructed from any suitable materials commonly used in cleaning scrubbers, such as metal or plastic mesh, scouring pad, foam, fabric and the like. Both the scrubbing plate 90 and scrubbing pad 92 may have a generally curved rectangular shape as shown in FIGS. 5 and 6. However, the scrubbing plate 90 and/or scrubbing pad 92 may also have several other different shapes so long as both the scrubbing plate 90 and scrubbing pad 92 may be fully received within opening 44 of the base 14. In alternative embodiments, the scrubbing pad 92 is affixed directly to the housing 56 without the use of the scrubbing plate.

The operation of the mop 10 and scrubbing mechanism 18 will now be described with particular reference to FIGS. 3 and 4. The spring 72 has a compression force $F_c$ that pushes the top wall 82 of the cavity 58 away from the axle 76. The axle 76 is secured to the base 14 through platen 20. As a result, the axle 76 moves in concert with the base 14. As shown in FIG. 3, when an insufficient force $F_1$ is applied to the spring 72, the spring 72 maintains the handle connector 16 and scrubbing mechanism 18 in a retracted position. When in the retracted position, the scrubbing pad 92 is located above the undersurface 42 of the mitt or cleaning pad 22 such that when the mop 10 is placed on a surface, such as a floor, the cleaning pad, and not the scrubbing pad 92, contacts the surface.

A sufficient force $F_2$ may be applied to the spring 72 that is greater than $F_c$ and sufficient to compress the spring 72. The axle 76 is secured to the base 14, and therefore the axle 76 and slide 74 maintain their position. However, as the spring 72 is compressed, the housing 56 moves downwardly such that the top wall 82 of the cavity 58 moves closer to the slide 74 and axle 76. As the scrubbing pad 92 is connected to the housing 56, the scrubbing pad 92 also moves downwardly with the housing 56. As a result, when a sufficient force $F_2$ is applied to the spring 72, the scrubbing pad 92 may engage the surface by extending below the undersurface 42 of the cleaning pad 22.

A user of the mop 10 may selectively place the mop 10 and scrubber mechanism 18 in either the retracted position (by applying a force less than $F_c$) or the extended scrubbing position by placing a force on the handle (not shown), and in turn, the handle connector 16. When the user places a normal moping force $F_1$ on the handle when pushing the mop 10 across a surface, the force $F_1$ is less than the compression force $F_c$ of spring 72 and the spring 72 does not compress. As a result, the handle connector 16 and scrubbing mechanism 18 remain in the retracted position where the scrubbing pad 92 is located above the undersurface 42 of the cleaning pad 22. However, when the user desires to use the scrubbing pad 92, the user may place a greater downward force $F_2$ on the handle (not shown), and in turn the handle connector 16. The sufficient downward force $F_2$ is greater than the compression force $F_c$ of the spring 72, thereby compressing the spring 72 a distance X within the cavity. The housing 56 may then move downward with respect to the axle 76 the same distance X. As a result, the scrubbing pad 92 is lowered below the undersurface 42 of the cleaning pad 22, enabling the user to use the scrubbing pad 92. When the user is finished using the scrubbing pad 92, the user may reduce the force applied to the handle to a force less than the compression force $F_c$ of the spring 72 in order to place the mop 10 and scrubbing mechanism 18 back into the retracted position.

Thus, there has been shown and described several embodiments of a novel mop with scrubber mechanism. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present invention will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

The invention claimed is:

1. A scrubbing mechanism comprising:

a handle;

a handle connector attached to the handle, said handle connector including an internal cavity enclosed by top, front, and rear walls of the handle connector;

a scrubbing pad positioned on a lower surface of the handle connector beneath the cavity;

a biasing mechanism positioned entirely within the cavity of the handle connector; and an axle positioned between the biasing mechanism and the scrubbing pad;

wherein the axle is secured to a mop base which can rotate about a longitudinal axis of the axle, and the biasing mechanism is positioned to bias the scrubbing pad toward a retracted position which is above a bottom surface of the mop base; and wherein application of a force sufficient to overcome the biasing mechanism results in movement of the scrubbing pad to an extended position in which the axle is entirely positioned within the cavity and the scrubbing pad is positioned below the lower surface of the mop base.

2. The scrubbing mechanism of claim 1 wherein the axle secures the handle connector to the mop base.

3. The scrubbing mechanism of claim 1 wherein said force sufficient to overcome the biasing mechanism applied to the handle connector causes movement of the scrubbing pad to the extended position.

4. The scrubbing mechanism of claim 1 wherein the biasing mechanism is a spring.

5. The scrubbing mechanism of claim 4 wherein the scrubbing mechanism is in the retracted position when the spring is not compressed within the housing cavity, and wherein the scrubbing mechanism is in an extended position when the spring is compressed within the housing cavity.

6. The scrubbing mechanism of claim 4 wherein the spring has a compression force, and wherein a handle force necessary to move the mop base across a surface is less than the compression force of the spring.

7. The scrubbing mechanism of claim 1 wherein the scrubbing pad has a curved rectangular shape.

8. The scrubbing mechanism of claim 1 wherein the mop base comprises a platen and a cleaning pad.

9. A floor mop comprising:

a mop base having an opening and a lower surface;

a handle connector located within the opening defined within the mop base, said handle connector attached to a handle, and said handle connector including an internal cavity enclosed by top, front, and rear walls of the handle connector; and a scrubbing mechanism comprising:

a scrubbing pad affixed to a lower surface of the handle connector beneath the cavity, a spring positioned entirely within the cavity of the handle connector, and an axle positioned between the spring and the scrubbing pad;

wherein the axle is secured to the mop base and the mop base can rotate about a longitudinal axis of the axle; and wherein compression of the spring causes the scrubbing pad to move below the lower surface of the mop base such that the axle is positioned within the cavity.

10. The mop of claim 9 wherein the scrubbing mechanism is in a retracted position when the spring is not compressed within the housing cavity, and wherein the scrubbing mechanism is in an extended position when the spring is compressed within the housing cavity.

11. The mop of claim 10 wherein the spring has a compression force, and wherein a handle force necessary to move the mop base across a surface is less than the compression force of the spring.

12. The mop of claim 9 wherein the scrubbing pad has a curved rectangular shape.

13. The mop of claim 9 wherein the mop base comprises a platen and a cleaning pad.

* * * * *